United States Patent [19]

Mattei et al.

[11] Patent Number: 4,756,315

[45] Date of Patent: Jul. 12, 1988

[54] CIGARETTE MANUFACTURING MACHINE WITH AN AUXILIARY TOBACCO FEED UNIT

[75] Inventors: Riccardo Mattei, Bologna; Bruno Belvederi, Monte S. Pietro; Franco Ghini, Bologna, all of Italy

[73] Assignee: G. D. Societa' Per Azioni, Bologna, Italy

[21] Appl. No.: 2,295

[22] Filed: Jan. 12, 1987

[30] Foreign Application Priority Data

Jan. 20, 1986 [IT] Italy ..... 3309A/86

[51] Int. Cl.[4] ..... A24C 5/39

[52] U.S. Cl. ..... 131/84.1; 131/109.1; 131/109.2; 131/109.3; 131/110

[58] Field of Search ..... 131/109.1, 109.2, 109.3, 131/110, 84.1

[56] References Cited

U.S. PATENT DOCUMENTS 4,524,781 6/1985 Seragnoli ..... 131/109.1

*Primary Examiner*—Vincent Millin

*Attorney, Agent, or Firm*—Marshall, O'Toole, Gerstein, Murray & Bicknell

[57] ABSTRACT

A cigarette manufacturing machine having an auxiliary recycled tobacco feed unit communicating with a downflow duct for feeding tobacco to a continuous cigarette rod forming section; the aforementioned auxiliary unit comprising an input conveyor belt communicating with a vibratory tray located between the output of the aforementioned conveyor and the aforementioned downflow duct; tobacco flow along the aforementioned input conveyor being regulated by mobile deflecting elements connected to means for controlling the tobacco level inside the aforementioned downflow duct.

5 Claims, 3 Drawing Sheets

FIG. 1
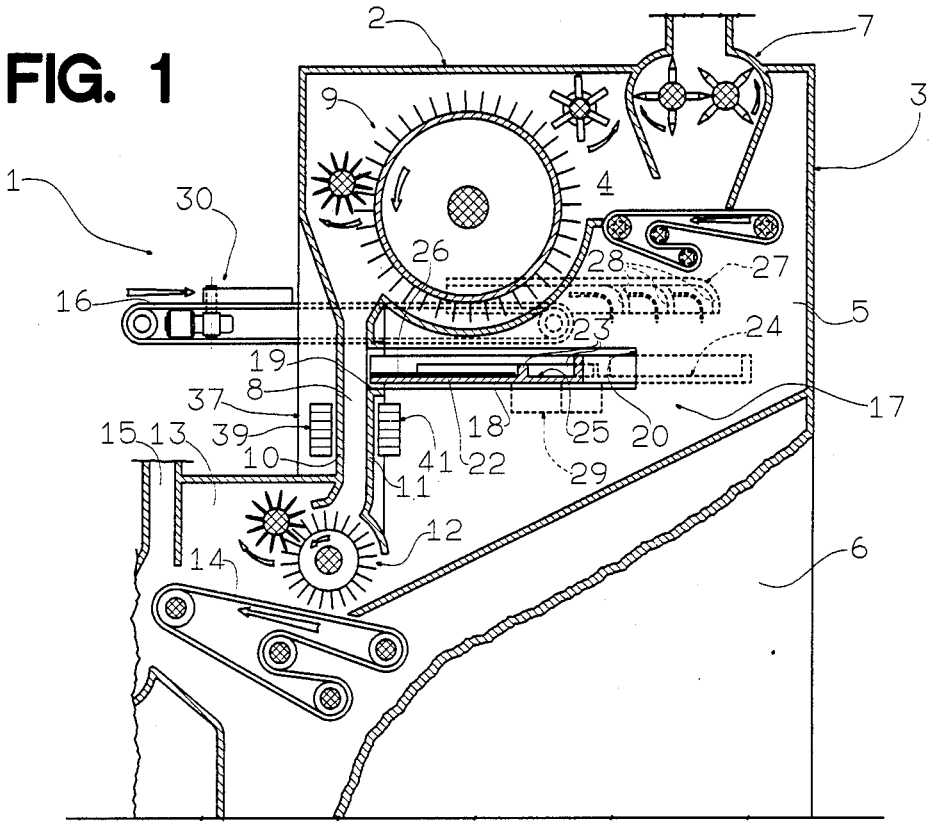
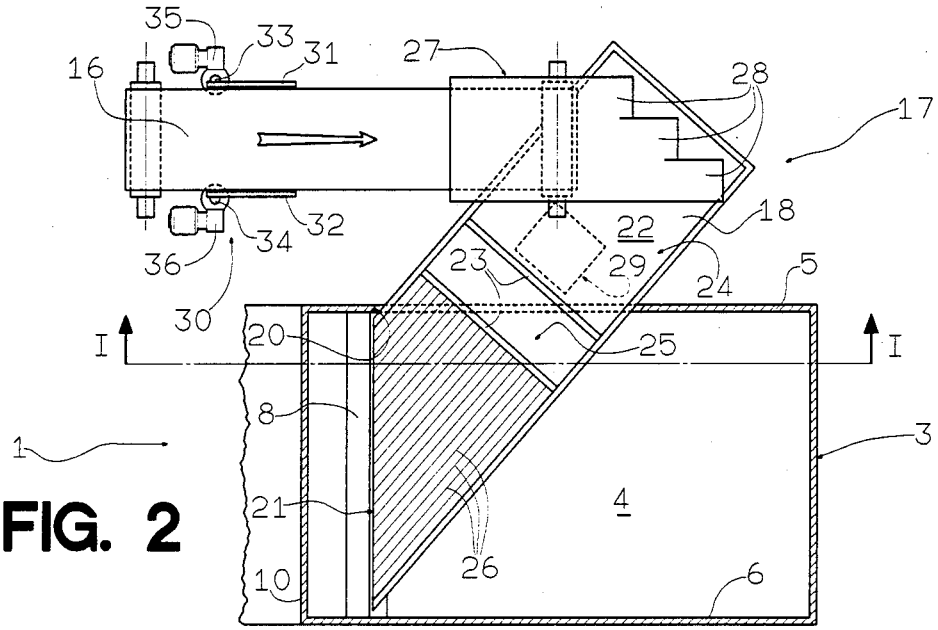
FIG. 2

CIGARETTE MANUFACTURING MACHINE WITH AN AUXILIARY TOBACCO FEED UNIT

BACKGROUND OF THE INVENTION

The present invention relates to a cigarette manufacturing machine having an auxiliary tobacco feed unit.

Cigarette manufacturing machines are known to comprise an input chamber from which shredded tobacco is withdrawn by a carding unit and fed into a downflow duct. At the bottom end of the said downflow duct, provision is made for a conveyor for feeding the tobacco to the bottom end of an upflow output duct.

The said downflow duct usually acts as a store for a permanent column of tobacco, from the bottom end of which tobacco is withdrawn continually by a toothed roller and fed onto the said conveyor.

Known manufacturing machines of the aforementioned type are usually fed partly with recycled tobacco recovered downstream from the said upflow duct by means of shavers and usually fed directly into the said input chamber.

Owing to the small size of the recycled tobacco particles and, consequently, the difficulty with which they are withdrawn by the carding unit, such a solution does not always ensure a sufficiently even tobacco level inside the said downflow duct.

A major drawback resulting from this is an uneven stream of tobacco formed by the said toothed roller on the said conveyor and, consequently, uneven distribution of the tobacco inside the continuous cigarette rod formed at the output of the said upflow duct.

One known solution for overcoming this drawback is to feed the recycled tobacco directly into the downflow duct, and to arrange, over the width of the said duct, a number of level indicators for detecting the height of the said tobacco column at various points. The signals supplied by the said indicators provide for controlling supply of the recycled tobacco into the said downflow duct, so as to maintain a constant tobacco level over the entire width of the duct.

For this purpose, recycled tobacco is known to be fed into the said downflow duct by means of a substantially horizontal, swing tray designed to turn about an axis parallel with that of the downflow duct. See, for example, U.S. Pat. No. 4,524,781. The said tray presents an outlet smaller in width than the said duct, and shifts in response to the said signals for supplying recycled tobacco wherever it is needed for leveling off the top of the tobacco column.

As the said outlet moves through an arc of a circle, one drawback of the aforementioned swing tray is that it requires a downflow duct with a very large section, so large, in fact, that, due to the said duct acting as a tobacco store, the tobacco inside the duct tends to compact, thus resulting in uneven distribution on the said supply conveyor.

For leveling off the tobacco column inside the said downflow duct, another known auxiliary recycled tobacco feed unit provides for feeding the tobacco into the duct by means of a vibratory tray. The said tray is connected to one or more vibrating units designed to vibrate the tray by varying amounts at different points, depending on the signals supplied by the said tobacco level indicating means arranged at various points in the downflow duct. Consequently, instead of being constant over its entire width, the speed of the stream of tobacco fed onto the tray varies at different points, as required for leveling the tobacco column inside the downflow duct.

Auxililary feed units of the aforementioned type have only proved successful in compensating for relatively small, brief differences in the tobacco level inside the downflow duct. Futhermore, owing to the necessarily limited number of vibrating units employed and interaction between the same, such compensation is both inaccurate and slow in reponse to the control signals supplied by the said indicating means.

SUMMARY OF THE INVENTION

The aim of the present invention is to provide a cigarette manufacturing machine featuring a recycled tobacco feed unit involving none of the aforementioned drawbacks. With this aim in view, according to the present invention, there is provided a cigarette manufacturing machine having an auxiliary tobacco feed unit, said machine comprising a downflow duct for supplying shredded tobacco, said duct communicating at the top with a main tobacco feed device, having tobacco level detecting means inside, and communicating laterally with tobacco feeding means forming part of the said auxiliary unit; characterised by the fact that it comprises tobacco deflecting means connected to the said detecting means, for moving the tobacco on the said feeding means crosswise in relation to its traveling direction.

BRIEF DESCRIPTION OF THE DRAWINGS

A number of embodiments of the present invention will be described, by way of non-limiting examples, with reference to the accompanying drawings, in which:

FIG. 1 shows a schematic section along vertical line I—I in FIG. 2 of a preferred embodiment of the cigarette manufacturing machine according to the teachings of the present invention;

FIGS. 2 to 5 show schematic plans views of a detail in FIG. 1 in four different operating positions;

DETAILED DESCRIPTION OF THE INVENTION

Figure 3:
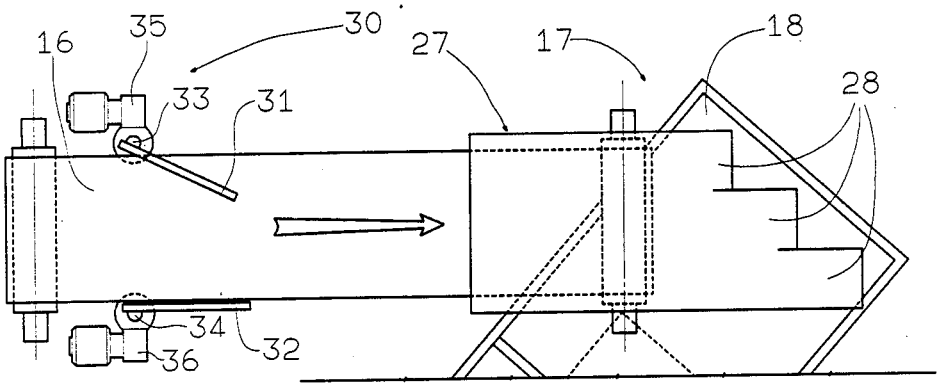
Figure 4:
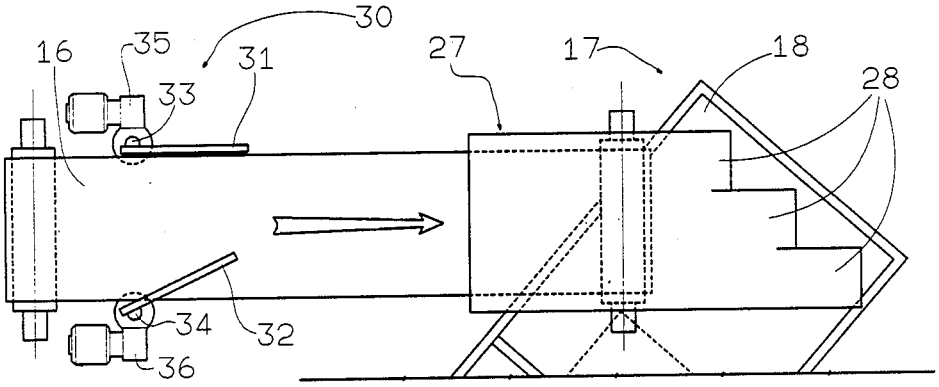
Figure 5:
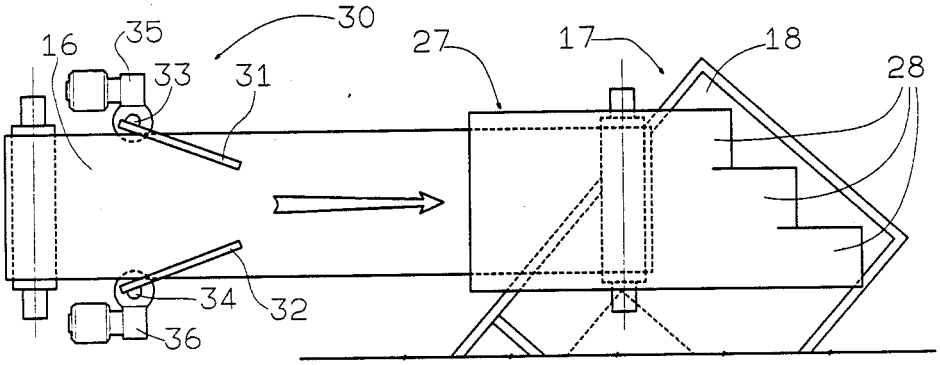
Figure 6:
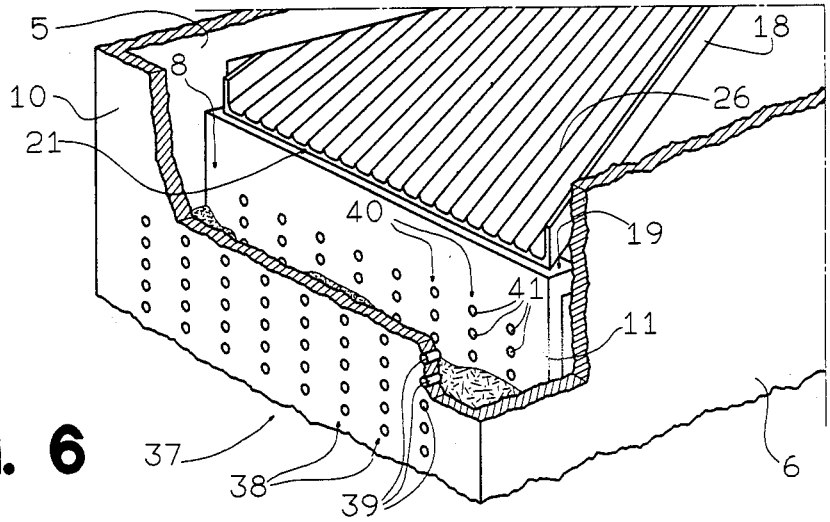
FIG. 6 shows a view in perspective of a further detail in FIG. 1.

FIG. 1 shows a cigarette manufacturing machine 1 comprising a distributor 2 for forming, from a mass of shredded tobacco, a continuous, even stream of tobacco particles. The component parts of distributor 2 are housed in a vertical casing 3 defining a chamber 4 limited laterally by two vertical walls 5 and 6.

Shredded tobacco is fed into chamber 4 by a main feed device 7, and transferred into a downflow duct 8 by a carding unit 9.

Duct 8 presents a substantially rectangular section and is limited widthwise by two substantially vertical walls 10 and 11 perpendicular to walls 5 and 6.

The bottom end of duct 8 comes out facing a toothed output unit 12 for withdrawing tobacco from duct 8.

Unit 12 transfers the tobacco, in the form of separate particles, into a chamber 13 the bottom wall of which is defined by a belt 14, referred to as a collecting belt, traveling, as viewed in FIG. 1, upwards from right to left. The output end of belt 14 is adjacent to the bottom end of an upflow duct 15 the top end (not shown) of which communicates with a unit (not shown) for forming a continuous cigarette rod.

As is generally known, on the said rod forming unit, the tobacco particles cling to the underside of at least one suction conveyor belt (not shown) to form a layer of tobacco (not shown) the thickness of which is evened off by means of a shaving device (not shown).

The tobacco removed by the said shaving device is fed, by means of conveyors (not shown), onto an input conveyor belt 16 located underneath chamber 4 and constituting a feeding means forming part of an auxiliary feed unit 17 for recycling the tobacco removed by the said shaving device.

In addition to conveyor 16, auxiliary feed unit 17 also comprises a substantially horizontal tray 18 the input end of which is located beneath the output end of conveyor 16, and the output end of which communicates with a mid point on duct 8 via a lateral opening 19 formed in wall 11 of the same.

As shown in FIGS. 2 to 5, conveyor 16 extends beyond wall 5 and presents a substantially constant width smaller than that of tray 18. The said tray 18 is inclined in relation to both conveyor 16 and wall 5, and extends through an opening 20 in the said wall 5 as far as opening 19 in wall 11.

Tray 18 is of substantially constant width, and is arranged with its input end beneath the output end of conveyor 16. At its output end, tray 18 is limited by an edge 21 inclined in relation to the longitudinal axis of tray 18, so as to give a length substantially equal to the width of opening 19 and, duct 8.

Tray 18 presents a bottom wall 22 an input portion of which is provided with two transverse ribs 23 defining two successive tanks 24 and 25 in the traveling direction of the tobacco along tray 18. An output portion of wall 22, on the other hand, is provided with a number of longitudinal ribs 26 for guiding the tobacco as it travels towards duct 8.

Conveyor 16 is designed, in use, to feed the tobacco into tank 24 and to arrange it over tray 18. This is achieved by providing for a distributor element, indicated as a whole by 27, comprising a number of curved panels 28 turned downwards towards tank 24, aligned with the axis of conveyor 16, and each designed to intercept a respective longitudinal strip of the tobacco stream supplied by conveyor 16, and to direct it onto a respective portion of tank 24. In more detail, panels 28 are of different lengths, and arranged with their curved free ends aligned along a line substantially perpendiculatr to the longitudinal axis of tray 18.

Bottom wall 22 of tray 18 is connected to a vibrating unit 29 designed to vibrate tray 18 for feeding the tobacco towards duct 8.

On conveyor belt 16, there is provided a tobacco deflecting device 30 comprising two deflecting elements, 31 and 32, on opposite sides of conveyor 16 (FIGS. 2 to 5). Each of the said deflecting elements 31 and 32 consists of a vertical, horizontally elongated blade or wall with its bottom edge next to conveyor belt 16. In relation to the traveling direction of the tobacco along conveyor 16, the rear end of each of blades 31 and 32 is integral with the top end of a respective vertical shaft, 33, 34, on a respective actuating device, 35, 36, designed to turn respective shaft 33, 34 about its own axis.

Actuators 35 and 36 are connected to control means consisting of a detecting unit 37 comprising a number of parallel columns 38 of optical detectors consisting of photocells 39 on wall 10, and a number of corresponding columns 40 of light emitting elements 41 on wall 11, for detecting, over substantially the entire width of duct 8, the height of the tobacco column inside the same.

In actual use, when columns 38 of photocells 39 detect an even tobacco level over the entire width of duct 8, i.e. when the tobacco inside duct 8 intercepts the light rays emitted, in each column 40, by the same number of emitting elements 41 underneath the surface of the tobacco, photocells 39 operate actuators 35 and 36 so that shafts 33 and 34 maintain blades 31 and 32 parallel with conveyor 16 as shown in FIG. 2. With blades 31 and 32 so arranged, tobacco is supplied by conveyor 16 with no assistance from deflecting device 30.

If, on the other hand, photocells 39 detect a high surface level of tobacco in the portion of duct 8 closest to conveyor 16, photocells 39 operate actuator 35 so as to turn shaft 33 and position blade 31 (FIG. 3) in such a manner as to deflect the intercepted tobacco towards the centre of conveyor 16.

The same applies if photocells 39 detect a high surface level of tobacco in the portion of duct 8 furthest away from conveyor 16, in which case, photocells 39 operate actuator 36 so as to turn shaft 34 and position blade 32 (FIG. 4) in such a manner as to deflect the intercepted tobacco towards the centre of conveyor 16.

Should photocells 39 detect a low tobacco level in the centre portion of duct 8, both actuators 35 and 36 are operated for positioning blades 31 and 32 (FIG. 5) in such a manner as to intercept the tobacco at the edges of conveyor 16 and deflect it towards the centre of the same for increasing the amount of tobacco supplied to the said centre portion of duct 8.

The aforementioned embodiment of the auxiliary feed unit according to the present invention provides for setting blades 31 and 32 by means of respective actuators 35 and 36 in only two extreme positions, whereas provision may be made for proportional positioning of blades 31 and 32, i.e. regulated gradually by photocells 39, depending on the number and location of the photocells lit up by light emitting elements 41. In more detail, for example, the illuminated photocells 39 in each column 38 may emit voltage signals, which may be added by adding circuits for controlling actuators 35 and 36 in known manner in proportion to the number of illuminated photocells 39.

To those skilled in the art it will be clear that changes may be made to the auxiliary feed unit as described and illustrated herein without, however, departing from the scope of the present invention.

Figure 7:
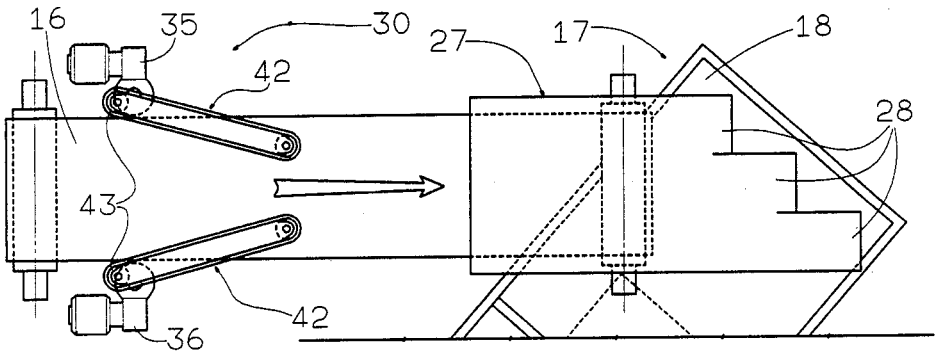
FIGS. 7 and 8 show schematic plan views of two variations of a detail in FIG. 1.

Deflecting elements 31 and 32 may be designed differently from those described herein, and may comprise, for example, a number of blades similar to those described herein and arranged in any manner in relation to conveyor 16. Blades 31 and 32 may be replaced by elements operating "actively" on the tobacco and consisting, for example, as shown in FIG. 7, of conveyor belts 42 mounted on vertical shafts, arranged laterally in relation to conveyor 16, and moving, similarly to blades 31 and 32, about the rotation axis of a respective end roller 43 by virtue of photocells 39.

Figure 8:
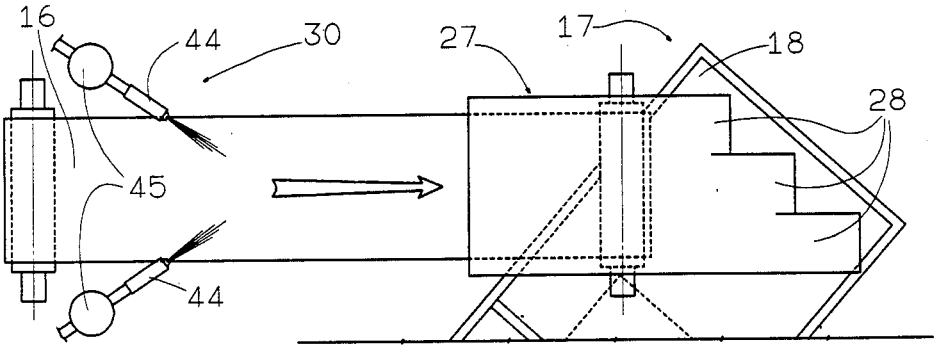

As shown in FIG. 8, deflecting device 30 could also employ non-mechanical deflecting elements, e.g. compressed air nozzles 44 located on opposite sides of conveyor 16 and designed to direct air jets onto the tobacco for moving it crosswise in relation to conveyor 16. In this case, elements 44 could be activated by valve means 45 connected to detecting unit 37 and located along ducts connecting elements 44 to a compressed air source.

Tray 18 could even be dispensed with, and the recycled tobacco fed into duct 8 straight off conveyor 16, or off a conveyor belt (not shown) provided in place of tray 18. In the latter case, deflecting device 30 could, naturally, be connected to the said conveyor.

Finally, the said deflecting device 30 could be connected to tray 18 instead of the said conveyor belts.

We claim:

1. A cigarette manufacturing machine comprising:

a main tobacco feed device (7);

a downflow duct (8) for shredded tobacco, said duct (8) extending downwards from said main tobacco feed device (7);

an intermediate lateral transverse aperture (20) provided in said duct (8) and extending over the whole width thereof;

an auxiliary tobacco feed unit (17) communicating with said duct (8) at said aperture (20);

the auxiliary feed unit (17) comprising tobacco conveying means (16, 18) having an output end arranged at said aperture (20) and fixed in relation thereto, and tobacco deflecting means (31, 32; 42, 44) associated with said conveying means (16, 18) to displace the tobacco conveyed thereby in relation to said conveying means (16, 18) and crosswise in relation to a traveling direction thereof; and detector means (37) for detecting the levels of tobacco at a number of points across said duct (8), and for controlling said deflecting means (31, 32; 42, 44) to maintain said levels within a predetermined range of variation.

2. A machine as claimed in claim 1 wherein said deflecting means comprises two substantially vertical wall means arranged on opposite sides of said tobacco conveying means (16, 18), and actuating means (35, 36) to move said wall means in relation to said conveying means between noninterference and interference positions in relation to the tobacco on said conveying means; said actuating means (35, 36) being controlled by said detector means (37).

3. A machine as claimed in claim 2 wherein each said wall means comprises a blade (31, 32) and a vertical rotary shaft (33, 34); said blade (31, 32) being connected to said shaft (33, 34) for rotation therewith, and said shaft (33, 34) being an output member of said actuating means (35, 36).

4. A machine as claimed in claim 2, wherein each said wall means comprises two vertical rotary rollers (43), an endless belt (42) wound about said rollers, and a vertical rotary shaft (33, 34); one of said rollers being connected to said shaft for rotation therewith, and said shaft being an output member of said actuating means (35, 36).

5. A machine as claimed in claim 1 wherein said deflecting means comprises pneumatic circuit means for compressed air, said circuit means comprising output nozzles (44) arranged on opposite sides of said conveying means (16, 18), and pressure control valves (45) for said nozzles; each said valve being controlled by said detector means (37).

* * * * *